United States Patent [19]

Erickson

[11] Patent Number: 4,670,031

[45] Date of Patent: Jun. 2, 1987

[54] INCREASED ARGON RECOVERY FROM AIR DISTILLATION

[76] Inventor: Donald C. Erickson, 1704 S. Harbor La., Annapolis, Md. 21401

[21] Appl. No.: 728,264

[22] Filed: Apr. 29, 1985

[51] Int. Cl.[4] ..... F25J 3/04

[52] U.S. Cl. ..... 62/22; 62/30; 62/31; 62/33; 62/34; 62/39

[58] Field of Search ..... 62/22, 27, 29, 31, 33, 62/34, 42, 44, 38, 39, 30, 36

[56] References Cited

U.S. PATENT DOCUMENTS

| | | | |
|---|---|---|---|
| 1,607,323 | 11/1926 | Van Nuys | 62/34 |
| 1,619,909 | 3/1927 | Wilkinson | 62/34 |
| 2,316,056 | 4/1943 | De Baufre | 62/22 |
| 2,934,907 | 5/1960 | Scofield | 62/22 |
| 3,210,951 | 10/1965 | Gaumer | 62/29 |
| 3,729,943 | 5/1973 | Petit | 62/22 |
| 4,133,662 | 1/1979 | Wagner | 62/13 |

FOREIGN PATENT DOCUMENTS

| | | | |
|---|---|---|---|
| 55-68571 | 5/1980 | Japan | 62/22 |

*Primary Examiner*—S. Leon Bashore
*Assistant Examiner*—Andrew J. Anderson

[57] ABSTRACT

Process and apparatus are disclosed for increasing argon recovery in conjunction with cryogenic distillation of air to high purity oxygen. The increased argon recovery is obtained by incorporating one or more latent heat exchangers in the flowsheet at strategic disclosed locations and between specific fluids. The invention is particularly advantageous in conjunction with LOXBOIL flowsheets, which otherwise lose $O_2$ recovery when argon recovery is increased.

19 Claims, 2 Drawing Figures

INCREASED ARGON RECOVERY FROM AIR DISTILLATION

DESCRIPTION

1. Technical Field

This invention relates to processes and apparatus for separating air into at least high purity oxygen (approximately 99.5% purity or higher) and co-product crude argon (approximately 80 to 99% purity). The invention permits recovery of a substantially greater fraction of crude argon that has been possible heretofore, with at most a neglibible offsetting increased energy penalty. Argon is useful in steel production, welding, and other inert atmosphere applications.

2. Background Art

An example of the typical modern approach to generating high purity oxygen plus co-product crude argon by cryogenic distillation is presented by R. E. Latimer in "Distillation of Air", *Chemical Engineering Progress* Volume 63 No. 2, February 1967, published by the American Institute of Chemical Engineering. Other examples can be found in U.S. Pat. Nos. 4,433,990, 3,751,934, and 3,729,943.

The distillation column configuration normally encountered comprises a lower column and upper column in heat exchange relationship, i.e., a "dual pressure" column, and an auxiliary crude argon column which directly connects to an intermediate height of the upper column. Functionally, the lower column is a rectifying column which receives the cooled and cleaned supply air at its base, pressurized to about 6 ATA. The overhead rectification product $N_2$ condenses against boiling oxygen bottom product of the upper or low pressure (LP) column, which has a bottom pressure of about 1.5 ATA. The LP column has three sections which accomplish different functions. The bottom section strips argon from the oxygen so as to achieve product purity. Above this section the column is divided into two sections. One section receives the partially evaporated kettle liquid from the high pressure (HP) rectifier bottom as feed, and distills or removes the nitrogen overhead from that liquid, leaving a fairly pure oxygen-argon liquid mixture which drops into the argon stripping section. The second top section is the argon rectifying section, in which the fraction of reboil entering it from the common connection point of the three sections is rectified to crude argon overhead, plus a fairly pure oxygen-argon liquid mixture which also drops into the argon stripping section. Thus vapor transiting up through the argon stripping section splits into two streams, one continuing up the $N_2$ removal section and the other going up (reboiling) the argon rectification section. Similarly liquid transiting downward through the latter two sections combines at the common connecting point, and all the combined liquid flow continues refluxing downward through the argon stripping section.

The overhead of the argon stripping section is normally cooled (refluxed) by indirectly exchanging latent heat with at least part of the kettle liquid, and the resulting at least partially evaporated kettle liquid is fed to the $N_2$ removal section. The $N_2$ removal section is normally refluxed by direct injection of liquid $N_2$ ($LN_2$) from the HP rectifying overhead product into the top of the $N_2$ removal section.

The problems which limit the amount of crude argon possible to recover with the above configuration are as follows. The relative reboil rates up the two top sections of the LP column are the primary determinants of the argon recovery. About 10% of the argon appears as impurity in the oxygen product, and the remainder is split between the overhead products of the $N_2$ removal section and the argon rectification section in rough proportion to the amounts of reboil up each section. The combined reboil entering those two sections is a fixed amount, namely that going up the argon stripping section. The $N_2$ removal section has a minimum reboil requirement--the amount necessary for it to reach its feed introduction point without pinching out. The more oxygen present on the feed plate or tray, the lower that reboil requirement. This is why designs which totally evaporate kettle liquid are more efficient than those which only partially evaporate it for argon rectifier reflux: The totally evaporated feed is introduced at a tray having higher $O_2$ content than the partially evaporated feed.

Since there is a minimum $N_2$ removal section reboil requirement, and a fixed total amount of reboil available, there is correspondingly a maximum amount of reboil available for the argon rectifier. In order to increase argon recovery, it is necessary to decrease the $N_2$ removal section reboil to below its minimum allowed amount, and to increase argon rectifier reboil to above its maximum allowed amount. This is not possible with present designs.

In one prior art reference, U.S. Pat. No. 3,729,943, some increase in argon recovery is achieved by increasing the reboil through the argon stripping section only. This is done by locating a latent heat exchanger at the common connection point between the three sections of the LP column, and evaporating $LN_2$ or LOX in that exchanger. By increasing reboil through the argon stripping section, a higher $O_2$ purity is obtained (assuming the same number of trays/countercurrent contact stages/theoretical plates). Thus up to 10% less argon exits with the $O_2$ product. However, the saved argon is still split in the same proportions between the $N_2$ removal section and the argon rectification section, and hence only part of it is actually recovered. This is because the reboil rates through those two sections are unchanged. Even though the latent heat exchanger is physically located in the bottom of the argon rectifier, all the trays of the argon rectifier are above the latent heat exchanger, and hence the latent heat exchanger causes no added reboil through any of the countercurrent contact part of the argon rectifier.

In the above disclosure, when $LN_2$ is evaporated, that vapor is work expanded to produce the required process refrigeration. This vapor is at a substantially lower pressure than the HP rectifier overhead vapor, e.g., at 4.5 ATA vice 6 ATA. Accordingly a proportionately larger amount must be expanded to produce a given refrigeration requirement. In modern "LOXBOIL" plants this will have an adverse impact on $O_2$ recovery, LOXBOIL plants are those in which the product oxygen is evaporated by latent heat exchange against condensing air vice against condensing HP rectifier overhead gas (typically 99% purity $N_2$). This substantially increases the delivery pressure of the product oxygen, but it substantially decreases the amount of $LN_2$ available to reflux the $N_2$ removal section and HP rectifier, and thus decreases the ability to rectify the $O_2$ out of those two overhead products. LOXBOIL plants can recover about 97% of the oxygen as product provided only 8 to 10% of the feed gas is work expanded, but any additional work expansion causes a reduction in achievable $O_2$ recovery. Thus the prior art disclosure, in a LOXBOIL context, provides some additional argon recovery but at the expense of reduced product oxygen recovery.

There is another reason why attempts to increase argon recovery have an adverse impact on $O_2$ recovery of LOXBOIL plants, even in the absence of the $LN_2$ evaporator disclosed in the prior art. As argon recovery increases (and holding argon purity constant) there are two different and additive effects which both require increases in the reboil rate up the argon rectification section. First, greater mass flow out the top (overhead product) at a fixed column L/V will require a linearly proportional increase in V (reboil). More importantly, however, as the argon recovery increases, the argon concentration at the common connecting point between the three LP column sections decreases. For most modern plants having a recovery of about 60%, that concentration is about 9 or 10% argon. For 0 recovery, it must increase to about 17%, to force all the argon up the $N_2$ removal section. If full recovery were possible, it would decrease to about 4%. As argon recovery is increased, and that concentration correspondingly decreases, the feed vapor to the argon rectification section is located lower on the equilibrium line of the McCabe-Thiele diagram, and hence a decreased L/V is actually required, thus further increasing both the reboil and reflux requirement.

With two requirements to increase the reboil and reflux, more kettle liquid must be evaporated to supply the reflux: at the limit, all is evaporated. This, however, shifts the $N_2$ removal section feed point substantially down the equilibrium line, to the extent that the refluxes available to the $N_2$ removal section can no longer rectify sufficient oxygen out of the overhead nitrogen, and hence $O_2$ recovery suffers.

From the foregoing it can be seen that the need which exists in this technical field, and one objective of the present invention, is to provide a means for increasing argon recovery without decreasing the oxygen recovery, purity, or delivery pressure, or increasing the input energy requirements. Specifically, the objectives are to increase the argon rectifier reboil and decrease the $N_2$ removal section reboil relative to what is possible now, without decreasing $O_2$ recovery; to provide additional refrigeration without decreasing reflux available to the $N_2$ removal section overhead; to recover a greater fraction of the increased argon obtained from increased reboil through the argon stripper via $LN_2$ depressurization; and other objectives.

DISCLOSURE OF INVENTION

The above objectives are achieved by providing process or apparatus wherein an exchange of latent heat is effected from an intermediate height of the argon rectifying section to an intermediate height of the $N_2$ removal section; and by providing a latent heat exchanger in which $LN_2$ is evaporated at an intermediate height of the argon rectification section, at least two theoretical plates above the bottom and preferably more than five, and work expanding the resulting evaporated $N_2$ so as to produce refrigeration. Either of the above measures taken singly will increase the argon recovery, and taken together they provide a cooperative effect to even further increase argon recovery over what is currently possible. The exchange of latent heat from the argon rectifier to the $N_2$ removal section does not have an adverse effect on $O_2$ recovery. In order to ensure that the $LN_2$ evaporation latent heat exchanger does not adversely impact $O_2$ recovery, it is desirable to also incorporate a means for partial expansion refrigeration whereby a nitrogen containing gas is work expanded to an intermediate pressure ("partially" expanded) and then condensed against intermediate height liquid from the $N_2$ removal section, thereby providing intermediate reboil to that section, and the resulting liquefied nitrogen containing gas is injected into the $N_2$ removal section as reflux therefor.

BEST MODE FOR CARRYING OUT THE INVENTION

Figure 1:
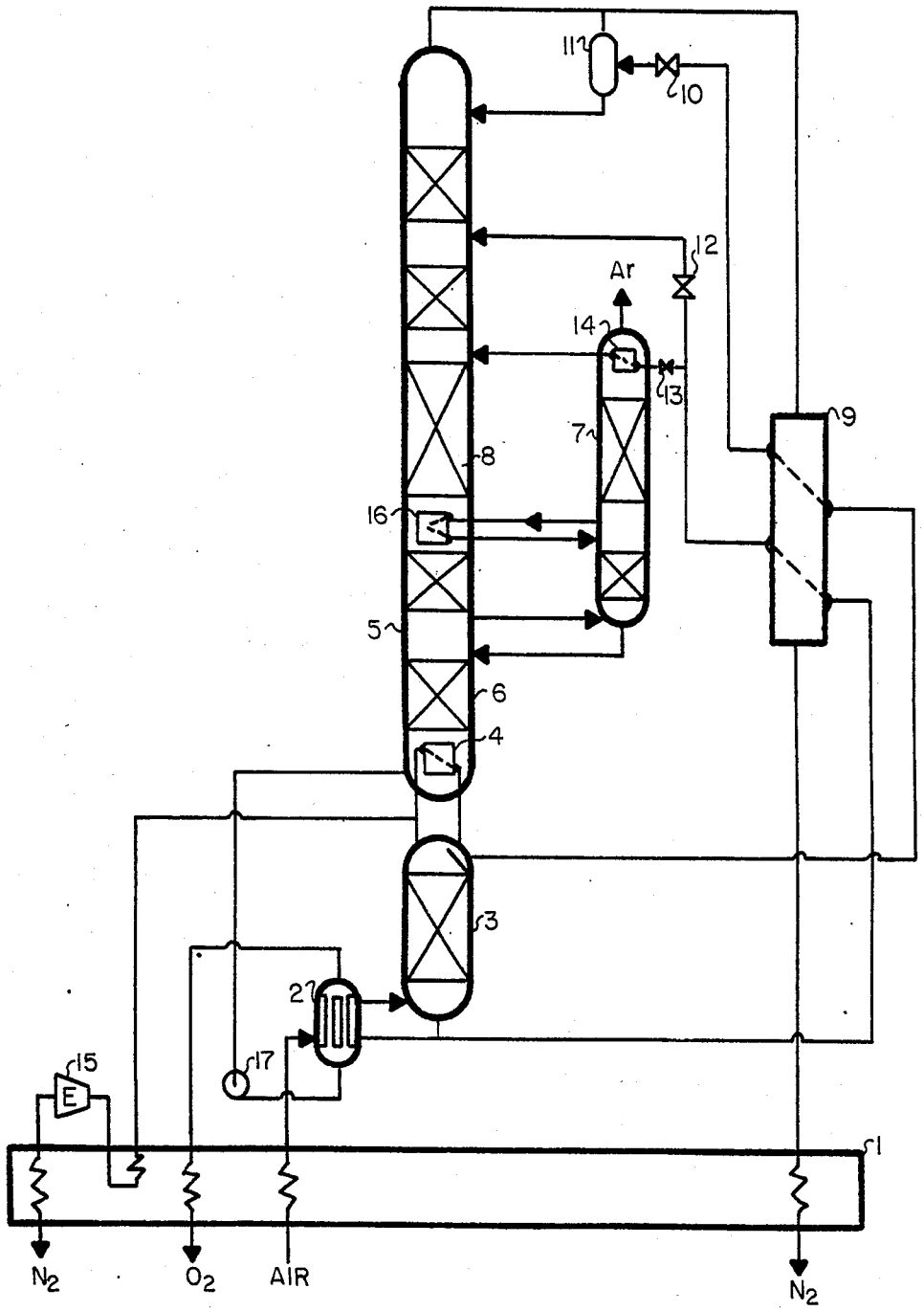
FIG. 1 illustrates the incorporation of the latent heat exchanger between the argon rectifier and the $N_2$ removal section into a conventional LOXBOIL dual pressure air separation apparatus with auxiliary argon sidearm (i.e., argon rectifier).

Referring to FIG. 1, air that has been compressed to about 6.3 ATA is cleaned of $H_2O$ and $CO_2$ and is cooled in main heat exchanger 1 to near its dewpoint, and then introduced into LOXBOIL evaporator 2 where it is partially condensed. The uncondensed portion is fed to HP rectifier 3, which is refluxed by latent heat exchanger 4, located in the bottom of low pressure column 5. The LP column is comprised of three sections: argon stripper 6, argon rectifier 7, and $N_2$ removal section 8, with all three having a common connection point 5.

Liquid $N_2$ overhead product from 3 is routed via sensible heat exchanger 9 and pressure letdown valve 10 into the overhead of $N_2$ removal section 8 as reflux therefor. This may optionally be via phase separator 11. Oxygen enriched liquid bottom product ("kettle liquid") from HP rectifier 3 and from LOX vaporizer 2 is also cooled and then letdown in pressure in valves 12 and 13 and fed to $N_2$ removal section 8. At least part of the kettle liquid may first be evaporated in latent heat exchanger 14, which provides reflux to argon rectifier 7. Crude argon is withdrawn overhead from that column; it may be withdrawn either as a liquid or vapor. In either case it would normally be increased in pressure and subjected to further purification.

Process cooling/refrigeration may be provided by withdrawing part of the HP rectifier 3 overhead $N_2$ as vapor phase, partially warming it in the complex of main exchanger 1, and then work expanding it in expander 15 and exhausting it via the main exchangers. Alternatively, as is known in the art, part of the supply air may be partially cooled and then work expanded to LP column pressure and fed to the $N_2$ removal section at the approximate height where liquid phase kettle liquid is introduced. The high purity liquid oxygen bottom product from the argon stripper is increased in pressure from about 1.5 to about 2 ATA and is evaporated in LOX gasifier 2. The pressure increase may be accomplished via a pump 17 or may be simply due to a barometric leg when the heights are appropriate, in which case 17 may be a means to preclude reverse flow and/or an adsorber for hydrocarbon cleanup.

The novelty of FIG. 1 is comprised of latent heat exchanger 16, and particularly the locations/intermediate heights of the two column sections it interconnects. "Intermediate height" means there is more than one theoretical stage of countercurrent vapor-liquid contact both above and below the height. Latent heat exchanger 16 accepts intermediate height vapor from argon rectifier 7, liquefies at least part of it, and returns the liquid to an intermediate height of argon rectifier 7, thereby providing intermediate reflux to the argon rectifier. At the same time it accepts intermediate height liquid from $N_2$ removal section 8, at least partially evaporates it, and returns the vapor to an intermediate height of the $N_2$ removal section, thereby providing intermediate reboil to that section. It is desirable that the intermediate height of the $N_2$ removal section be below the height at which kettle liquid is introduced.

Although latent heat exchanger 16 is illustrated as being physically located within section 8, it will be recognized that it could alternatively be physically located within section 7 or external to both sections. The only essential locations are those of the source and return point of the two fluids supplied it, which must be the respective intermediate heights disclosed. In general it is preferred that the argon rectifier intermediate height be at least 2 and more preferably 5 to 15 stages above the bottom.

The reason latent heat exchanger 16 allows more argon recovery can briefly be explained as follows. At the normal pinch point of section 8 where feed from exchanger 14 is introduced, the relative reboil rates up section 7 and up section 8 are approximately the same as in prior art configurations. However, lower in both those sections, below exchanger 16, part of the reboil which normally would go up section 8 has been diverted to section 7, and it doesn't transfer back to section 8 until exchanger 16. Thus the objective of increasing reboil from point 5 up section 7 and decreasing it up section 8 has been achieved. At the same time, there is very little change in the feed and reflux flows to section 8, and hence $O_2$ recovery is not degraded.

Figure 2:
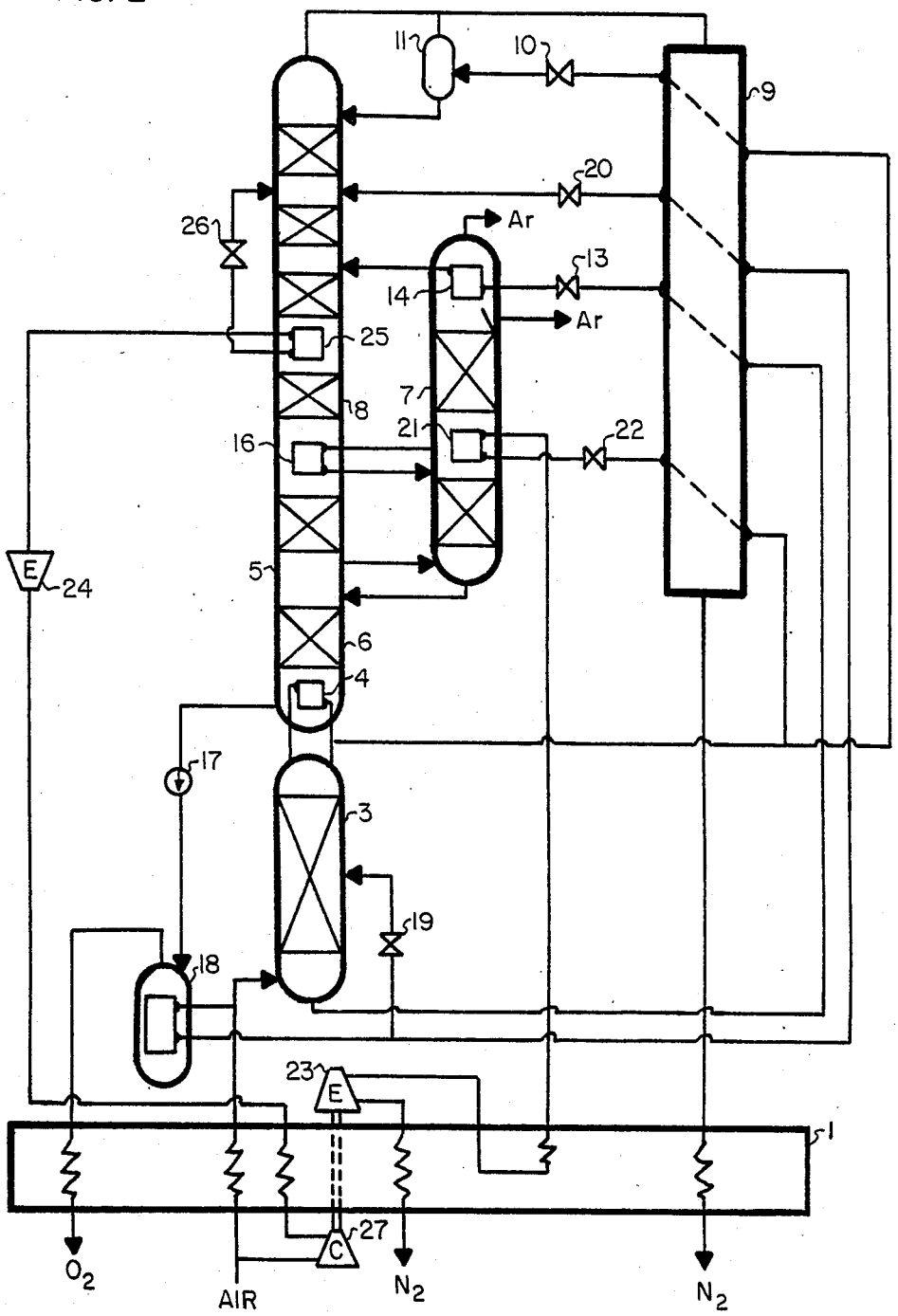
FIG. 2 illustrates the additional incorporation into a similar flowsheet of the $LN_2$ evaporation heat exchanger plus work expander and the partial expansion refrigeration expander plus latent heat exchanger.

In FIG. 2, the components having the same number as in FIG. 1 have similar or identical functions, LOX vaporizer 18 differs from the previously described one, 2, in that only part of the supply air is furnished to it, which totally condenses, as opposed to the partial condensation in 2. This lowers somewhat the achievable LOX evaporation pressure, but provides a source of liquid air (21% $O_2$) which can be used as intermediate reflux to either or both of the $N_2$ removal section 8 via letdown valve 20, and HP rectifier 3 via means for inducing one way flow 19 (i.e., a pump or a valve). With this intermediate reflux, somewhat less $LN_2$ reflux is necessary for full $O_2$ recovery.

In FIG. 2 part of the $LN_2$ is reduced in pressure by valve 22 and introduced into latent heat exchanger 21, which is located at an intermediate height of argon rectifier 7. There is no requirement that the exchanger 21 intermediate height be the same as the exchanger 16 intermediate height, as illustrated, but that is permitted. The reduced pressure $N_2$ vapor from exchanger 21 is partially warmed and then work expanded in expander 23 before being exhausted.

With exchanger 21 located where it is, vapor that was previously withdrawn from HP rectifier 3 overhead now transmits up argon stripper 6 and up the lower portion of argon rectifier 7, thus increasing the reboil through both of those components without any change in reboil in section 8. This permits increased argon recovery, and also higher $O_2$ purity and/or fewer stages of stripping. It also increases the proportion of the argon present at point 5 which transits up section 7 for subsequent recovery.

The increased argon recovery may require increased reflux from exchanger 14, which can adversely affect $O_2$ recovery. Also, if more $N_2$ flow is required to expander 23 than to expander 15, that can decrease $O_2$ recovery. To offset these effects, part of the supply air may be work expanded to an intermediate pressure in expander 24, and then evaporated in latent heat exchanger 25, which provides intermediate reboil to $N_2$ removal section 8. The liquid air is then let down in pressure via valve 26 and supplied as intermediate reflux to section 8. Even greater refrigeration can be developed by expander 24 if the air supplied to it is initially further compressed in compressor 27, driven by expander 23. Thus no additional power input is required for this additional refrigeration output.

It is emphasized that the components 24, 25, 26, and 27 are optional and may be omitted. Particularly on large plants, where proportionately less refrigeration is required, full $O_2$ recovery may be obtainable without them. On the other hand, they may nonetheless be desirable since the additional refrigeration may be put to other desirable uses, such as allowing some liquid production or decreasing the size and cost of the main exchanger.

The same beneficial effect that is provided by components 24, 25, and 26 using part of the supply air can also be accomplished using nitrogen from the overhead of HP rectifier 3 or from the discharge from exchanger 21. The nitrogen is partially work expanded in expander 24 in lieu of air, and then condensed in exchanger 25. The resulting liquid $N_2$ is then letdown in pressure in valve 26 and injected into the top of section 8, in lieu of an intermediate height. Other than the different source location of the nitrogen containing gas and the different reflux injection location of the resulting liquid, the only substantial difference is that the $N_2$ cannot be reduced in pressure as much as the air to achieve the desired condensing temperature.

Several variations or other possible combinations of the above disclosed features will be apparent to the practitioner of this art. The various disclosed features will be useful singly or in combination in the production of lower purity $O_2$ as well as 99.5+%. The three latent heat exchangers 16, 21, and 25 may be used singly or in combination in LOXBOIL plants based on either partial or total condensation of the supply air, or in plants having other means of gasifying the LOX, such as direct gasification in the LP column bottom or pumped LOX variations, as disclosed for example in U.S. Pat. No. 4,433,989.

The cleaning and drying means may be a front end treatment such as mol sieve (preferable) or any other conventional or suitable means such as reversing exchangers, regenerators, and the like.

Several products may be withdrawn, e.g., $O_2$ of different purities, $N_2$ coproduct, liquids, and the like. Other configurations or arrangements of sensible heat exchange may be used. Components illustrated singly may be in multiple units. When gaseous argon is withdrawn, it may be increased in pressure either inside or outside the cold box. The physical configuration of the columns and exchangers may be quite different from the schematic functional configuration illustrated by the figures.

It will be recognized that although both figures show part of the kettle liquid being evaporated to provide overhead reflux to the argon rectifier, the latent heat exchanger providing that reflux could alternatively be supplied intermediate height liquid from the $N_2$ removal section, from a height appropriately higher than the supply to the argon rectifier intermediate refluxer.

The argon rectifier intermediate refluxer 21 which is described above as being supplied with $LN_2$ could alternatively be supplied with liquid air, e.g., part of that from total condensation LOX evaporator 18. In that event the subsequently evaporated air would be fed to the $N_2$ removal section after expansion. This alternative is generally not as advantageous as evaporating $LN_2$, since for a given evaporation temperature the evaporated air will be at a lower pressure than evaporated $N_2$ removal section after expansion.

Compared to the prior art disclosure of locating an $LN_2$ latent heat exchanger at the common connection point between the three LP column sections, the present disclosure allows greater argon recovery at only very slight penalty. Locating the latent heat exchanger at least two trays up the argon rectifier, and preferably where the argon concentration is between 15 and 50%, decreases the evaporated $N_2$ pressure by at most 0.1 to 0.2 ATA.

It is emphasized that the various novel latent heat exchangers and intermediate heights described above need not be confined to a single tray, plate, or stage. They may extend over several tray heights, e.g., 5 or 10 or more, using the prior art disclosed non-adiabatic or "differential" distillation, e.g., as described in U.S. Pat. No. 3,508,412.

As a numerical example of one embodiment of the disclosed invention, the following operating conditions reflect results achievable in a flowsheet similar to FIG. 1 but with a total condensation LOX evaporator (i.e., component 18 vice 2). One thousand gram-moles per second ("m") of air is compressed to about 6.3 ATA, and 870 m is cleaned and cooled to 101 K and 6 ATA. 283 m is routed to the total condensation LOX evaporator, producing 203 m oxygen plus 1 m argon mixture (99.5+% pure oxygen) at 2.1 ATA and 98 K. 130 m of the air is expanded from 170 K and 6.1 ATA to 1.4 ATA and 119 K, and fed to the $N_2$ removal section. The remaining air, 587 m, is directed into the base of HP rectifier 3, and rectified into two liquid products. The overhead product, 323 m of $LN_2$ at about 98.4% purity, is routed to the top of the $N_2$ removal section as reflux. The bottom product, 462 m of kettle liquid containing 34.6% $O_2$, is split with 199 m being directly fed to the $N_2$ removal section via valve 12, and 263 m directed to overhead latent heat exchanger 14. The 283 m liquid air from LOX evaporator 18 is also split, with 198 m being fed to an intermediate height of HP rectifier 3, and the remaining 85 m being directed into $N_2$ removal section 8 as intermediate reflux therefor. 300.5 m of oxygen-argon vapor containing 6.6% argon is directed into the base of the argon rectifier 7, and 293.9 m liquid is returned at 4.7% argon concentration; the net argon product overhead is 6.6 m at 96% purity. 10 trays above the bottom of the argon rectifier, where the vapor is about 31% argon, approximately one-third of the reboil going up the argon rectifier is transferred to the $N_2$ removal section by intermediate latent heat exchanger 16. 1 m of oxygen product is withdrawn as liquid to prevent hydrocarbon buildup, and the remaining 788 m of waste $N_2$ is withdrawn from the overhead of $N_2$ removal section 8 which is at a pressure of 1.25 ATA.

For a conventional total condensation LOXBOIL flowsheet designed to produce the same $O_2$ purity, recovery, and delivery pressure as above, the argon recovery would be only 5.8 m, or about 60% recovery, vice 68% above.

The term "latent heat exchanger" merely signifies the primary source of the heat being transferred, and does not preclude the presence of other sources such as sensible heat.

I claim:

1. In a process for producing high purity oxygen and by-product argon by distilling cooled and cleaned air in a distillation apparatus comprised of a high pressure (HP) rectifier and a low pressure (LP) column comprised of an argon stripping section, a nitrogen removal section, and an argon rectifying section, the improvement comprising: exchanging latent heat between the argon rectifying section and the nitrogen removal section so as to provide intermediate reflux to the former and intermediate reboil to an intermediate height of the latter.

2. The process according to claim 1 further comprising directing feed fluid derived from at least part of HP rectifier bottom product to said $N_2$ removal section at a height above said intermediate reboil height.

3. The process according to claim 2 further comprising providing refrigeration by work expanding at least one of part of the supply air and part of the HP rectifier vapor; and evaporating pressurized argon stripper liquid oxygen bottom product by latent heat exchange with a totally condensing minor fraction of said supply air.

4. Process according to claim 3 further comprising dividing said condensed air into two streams and injecting them into intermediate heights of said HP rectifier and said $N_2$ removal section respectively as intermediate refluxes therefor.

5. The process according to claim 1 further comprising partially depressurizing liquid nitrogen ($LN_2$) overhead product from the HP rectifier, refluxing at least part of the argon stripping section of the low pressure column with a condensate obtained by exchanging latent heat with said partially depressurized $LN_2$; and work expanding the resulting gaseous partially depressurized $N_2$.

6. The process according to claim 5 further comprising obtaining the vapor for said exchange of latent heat with depressurized $N_2$ from an intermediate height of said argon rectifying section; and returning said condensate to an intermediate height of said argon rectifying section, whereby additional reboil and reflux passes through the lower portion of the argon rectifying section.

7. The process according to claim 1 further comprising partially work expanding a pressurized air stream; condensing said partially expanded stream by latent heat exchange with evaporating liquid from said LP column; and supplying the resulting condensate as reflux to the $N_2$ removal section.

8. The process according to claim 5 further comprising condensing a partially work expanded nitrogen containing gaseous stream from the HP rectifier so as to provide intermediate reboil to the LP column, and refluxing the LP column with the resulting condensate.

9. In a cryogenic air distillation apparatus for producing high purity oxygen plus byproduct argon comprised of a high pressure (HP) rectifier and a low pressure (LP) column comprised of an argon stripping section, a nitrogen removal section, and an argon rectifying section, the improvement comprising: means for exchanging latent heat from an intermediate height of the argon rectifying section to an intermediate height of the nitrogen removal section.

10. The apparatus according to claim 9 further comprised of means for exchanging latent heat between partially depressurized liquid overhead product from said HP rectifier and intermediate height vapor of said LP column; and means for work expanding the resulting evaporated liquid.

11. A process for producing high purity oxygen and byproduct argon by distilling air in a distillation apparatus comprised of a high pressure (HP) rectifier and a low pressure (LP) column comprised of an argon stripping section a nitrogen removal section, and an argon rectifying section, wherein the improvement comprises:

a. partially expanding liquid nitrogen from the HP rectifier overhead;
b. evaporating said partially expanded liquid nitrogen by exchanging latent heat with argon rectifying section intermediate height vapor;
c. refluxing the argon rectifier with the liquefied intermediate height vapor; and
d. work expanding said evaporated partially expanded nitrogen.

12. The process according to claim 11 further comprising locating said argon rectifying section intermediate height at least two theoretical stages above the bottom of said section.

13. The process according to claim 11 further comprising: evaporating essentially all of the liquid high purity oxygen bottom product from the low pressure column at a pressure greater than the bottom pressure of the LP column by exchanging latent heat with and condensing a fraction of the cooled and cleaned supply air; and injecting at least part of the resulting condensed air into the $N_2$ removal section at an intermediate height as intermediate reflux therefor.

14. Process according to claim 13 further comprising injecting a remaining part of said condensed air into the HP rectifier at an intermediate height as intermediate reflux therefor.

15. The process according to claim 11 further comprising: evaporating at least part of the liquid high purity oxygen bottom product from the LP column at a pressure higher than the LP column bottom pressure by latent heat exchange with at least a major fraction of partially condensing cooled and cleaned supply air.

16. The process according to claim 11 further comprising separately exchanging latent heat between a second intermediate height of the argon rectifying section which may be the same as said first intermediate height and an intermediate height of the nitrogen removal section, thereby providing intermediate reboil to the nitrogen removal section and a second source of intermediate reflux to the argon rectifying section.

17. The process according to claim 11 further comprising partially work expanding a pressurized nitrogen containing gaseous stream from the HP rectifier; condensing said partially expanded stream by latent heat exchange with evaporating intermediate height liquid from the $N_2$ removal section; and directly injecting the resulting condensate into the $N_2$ removal section as reflux therefor.

18. Apparatus for producing oxygen and argon comprised of a low pressure column which includes a nitrogen removal section and an argon rectifying section wherein the improvement comprises means for increasing argon recovery comprised of (a) a first latent heat exchanger in which intermediate height liquid from the $N_2$ removal section is evaporated and intermediate height vapor from the argon rectifier is condensed; and/or (b) a second latent heat exchanger in which intermediate vapor from the argon rectifier is condensed and liquid nitrogen is evaporated at an intermediate pressure and a work expander for said evaporated intermediate pressure nitrogen.

19. Apparatus according to claim 18 further comprised of a latent heat exchanger in which condensing $N_2$ containing gas provides intermediate reboil to the $N_2$ removal section, and an expander which discharges said $N_2$ containing gas.

* * * * *